United States Patent [19]

Riemenschneider, III

[11] Patent Number: 4,834,312

[45] Date of Patent: May 30, 1989

[54] TOOL FOR MANUALLY DISPENSING A WEB

[75] Inventor: Paul K. Riemenschneider, III, Grandville, Mich.

[73] Assignee: Highlight Industries, Inc., Grandville, Mich.

[21] Appl. No.: 175,539

[22] Filed: Mar. 31, 1988

[51] Int. Cl.[4] ..... B65H 75/40

[52] U.S. Cl. ..... 242/96; 242/99; 188/67

[58] Field of Search ..... 242/75.4, 96, 99; 188/67

[56] References Cited

U.S. PATENT DOCUMENTS

| | | | |
|---|---|---|---|
| 406,672 | 7/1889 | Schultze . | |
| 521,245 | 6/1894 | Patridge . | |
| 1,415,678 | 5/1922 | Moynihan . | |
| 2,917,249 | 7/1955 | MacLelland . | |
| 3,198,175 | 8/1965 | Dean . | |
| 4,166,589 | 9/1979 | Hoover et al. | 242/75.4 |
| 4,179,081 | 12/1979 | Parry | 242/99 |
| 4,226,380 | 10/1980 | Gay | 242/55 |
| 4,248,392 | 2/1981 | Parry | 242/96 |
| 4,477,037 | 10/1984 | Goldstein | 242/75.4 |
| 4,484,717 | 11/1984 | Goldstein | 242/96 |
| 4,722,493 | 2/1988 | Parry et al. | 242/96 |

*Primary Examiner*—Stuart S. Levy
*Assistant Examiner*—Steven M. DuBois
*Attorney, Agent, or Firm*—Varnum, Riddering, Schmidt & Howlett

[57] ABSTRACT

A dispensing tool for dispensing a stock material in web or tape form supplied in a roll on an open core with the stock material being under a selected tension. The tool includes a head forceably receivable in the core to support the stock material roll. The head has a spindle forming a handle, and a friction producing manually grippable unit is carried by the spindle. The manually grippable unit includes a split cylindrical member in which the spindle is journalled with the split cylindrical member being readily deformable to selectively grip the spindle and thereby restrain pay out of the stock material from the roll and thus tension the stock material. In order to facilitate gripping of the split cylindrical member in an operator's hand, a sleeve of rubber-like material having a foam appearing surface is telescoped over the split cylindrical member.

8 Claims, 3 Drawing Sheets

FIG. 3
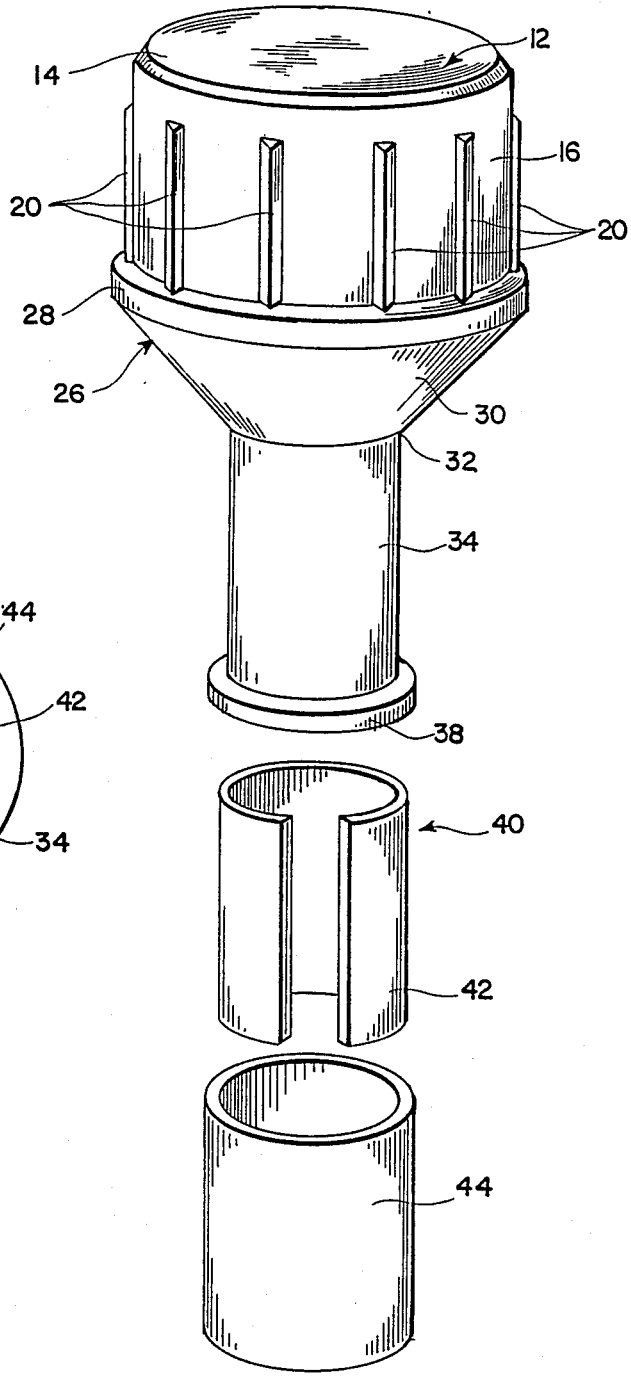
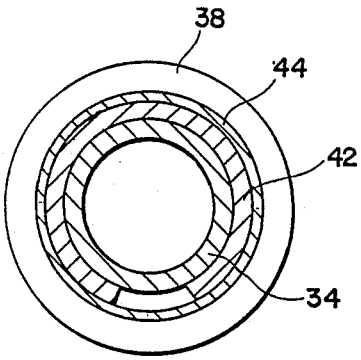
FIG. 2

TOOL FOR MANUALLY DISPENSING A WEB

TECHNICAL FIELD

This invention relates in general to new and useful improvements in dispensers, and more particularly to an improved dispenser for dispensing and applying an elongated flexible web from a roll.

BACKGROUND OF THE INVENTION

The application of plastic wrap and the like, such as plastic stretch wrap or tape, to packages by encircling the wrap about the packages, and utilizing an application too, is well known in the art.

U.S. Pat. No. 4,179,081 dated Dec. 18, 1979 and U.S. Pat. No. 4,248,392 dated Feb. 3, 1981, in the name of John C. Parry and entitled Apparatus for Application of Plastics Stretch Films, disclose an apparatus which consists of a pair of insertable adapters for the ends of a cylindrical core of a roll of plastic stretch film, with a pair of tubular-like flexible grip means on the insertable adapters for use in controlling the tension and speed on unrolling of the film from the roll, during the application of the plastic film to packaging units. The rubber-like grip means become soiled, and may be misplaced or lost and therefore may not be readily available or conveniently locatable for use in applying the plastic film to the packaging units.

Also known in the art is a plastic film applicator tool or apparatus which includes a head and a spindle projecting from said head, with the head being rotatable relative to the spindle and having a selectively adjustable braking means therein for adjusting the rotational frictional coaction between the rotatable head and the spindle, so that as the head rotates relative to the spindle and dispenses a web of plastic stretch film about packaging units, the tension and speed of unrolling of the stretch film is controlled by the amount of tension initially placed upon the mentioned braking mechanism disposed in the head. Such a tool is relatively complex and therefore relatively expensive and may be subject to mechanical problems as wear occurs, and is not conveniently adjustable when assembled with a roll of the film material. Such a tool is the subject of U.S. Pat. No. 4,477,037 to Goldstein granted Oct. 16, 1984.

There is further known in the art a simplified wrap applying tool and associated method wherein the tool comprises a head adapted to be received in anchored relationship in the open core of a roll of flexible web or tape material, and a spindle fixedly projecting from the head and adapted to extend outwardly of the roll. During use a wrap envelope web material encircles the spindle in relatively rotatable relation. The wrap envelope is adapted to control the tension and the speed of unrolling of the material from the roll while applying the material to a packaging unit. The operator can selectively cause a braking action between the spindle and the wrap envelope by manually squeezing the wrap envelope on the spindle, thus providing a tool for applying plastic wrap and the like to a packaging unit or units.

SUMMARY OF THE INVENTION

The present invention relates to a novel simple tool for dispensing and applying a web of flexible stock material in the form of a wrap or tape supplied in roll form on an open core. The tool includes a head of a size and shape to be forceably inserted in a core. Fixedly projecting from the head is a handle in the form of a spindle. The spindle carries grip means in which the spindle normally freely rotates and which grip means may be selectively squeezed to vary the friction between the grip means and the spindle so as to vary the tension in the stock material being applied.

More particularly the grip means includes a split cylindrical member telescoped over the spindle with the split cylindrical member being readily deformable by squeezing the same to vary the gripping of the spindle by the split cylindrical member and thus varying the resistance to rotation of the spindle within and relative to the split cylindrical member.

Another feature of the invention is the formation of the split cylindrical member of a resilient plastic material which is readily deformable for varying the gripping effect of the split cylindrical member on the spindle.

A further feature of the invention is the provision of a sleeve surrounding the split cylindrical member and forming a grip member for gripping the split cylindrical member and preventing relative rotation between an operator's hand and the split cylindrical member, the sleeve being formed of a rubber-like resilient material having a roughened foam appearing surface.

With the above and other objects in view that will hereinafter appear, the nature of the invention will be more clearly understood by reference to the following detailed description, the appended claims, and the several views illustrated in the accompanying drawings.

BRIEF DESCRIPTION OF THE DRAWINGS

FIG. 2 is a transverse sectional view through the spindle of the tool and shows the friction varying device carried by the spindle.

FIG. 3 is an exploded perspective view showing separately the various parts of the tool.

DETAILED DESCRIPTION OF THE INVENTION

Figure 1:
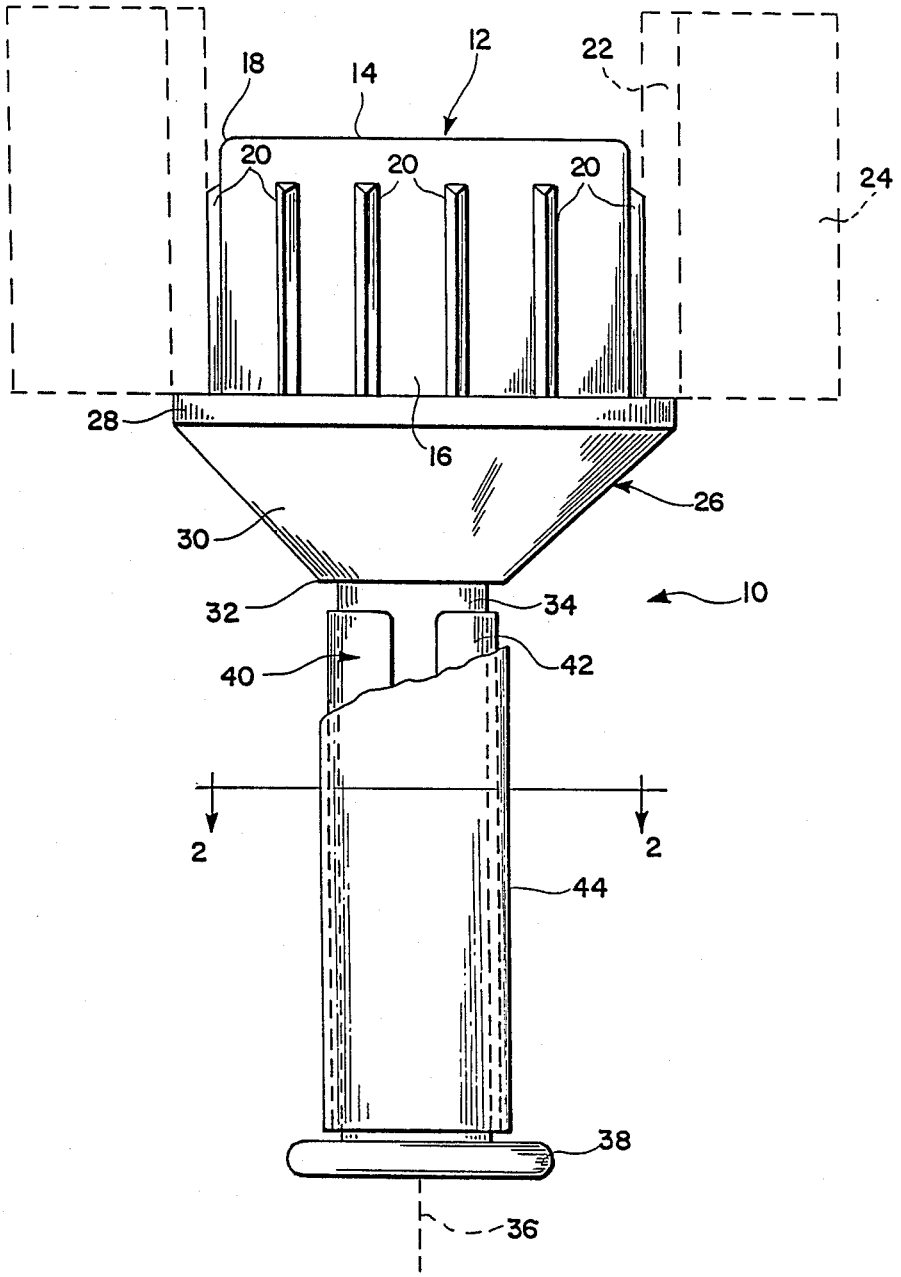
FIG. 1 is a side elevational view with parts broken away of the tool which is the subject of the invention with the head of the tool inserted into an open core of a roll of plastic film material which is shown in phantom lines.

Referring now to the drawings in detail, it will be seen that there is illustrated in FIGS. 1–3 the details of the dispensing tool which is the subject of the invention, the tool being generally identified by the reference numeral 10. The tool 10 specifically includes a cup-shaped head 12 having an end panel 14 and a generally cylindrical body 16 joined together by a rounded corner 18. The body 16 has radially projecting axial ribs 20 which may be arranged singularly or in groups.

As is best shown in FIG. 1, the body 16 and the axial ribs 20 are of a size and configuration to be forced into an open cylindrical core 22 on which there is to be mounted a roll 24 of stock material in web or tape form. The specific nature of the stock material does not form part of this invention although normally it will be in the form of a stretchable plastic film. Preferably the body 16 or the ribs 20 or both are flared or tapered away from the end panel 14.

The end of the cup-shaped head 12 remote from the end panel 14 is closed by a second cup-shaped member 26 including a cylindrical rim 28 which is telescoped over the body 16 and may be suitably secured to the body 16 such as by bonding. The cup-shaped member 26 also includes a frusto-conical end panel 30 having a small diameter central flat portion 32. The flat portion 32, in turn, carries an axially extending spindle 34 which functions as a handle for the tool 10. The spindle 34 is in the form of a tube and may be formed either separate from the cup-shaped member 26 and bonded thereto or formed integral with the cup-shaped member 26. The spindle 34 has an axis 36 which is coextensive with an axis of the cup-shaped head 12.

The spindle 34 at the end thereof remote from the cup-shaped member 26 is provided with an enlargement 38, the function of which will be described hereinafter.

It is to be understood that when the cup-shaped head 12 is forced into the core 22, the free edge of the rim 28 may function as a stop which will square the core 22 and roll 24 relative to the axis 36.

The portions of the tool 10 as described hereinabove are preferably integrally molded utilizing a suitable plastic material. More particularly, the spindle 34 will be formed of a plastic material and may have a smooth, or preferably, a slightly textured external surface.

The tool 10, as described, may be gripped in an operator's hand with controlled slippage between the operator's hand and the spindle 34. However, this would be hard on the operator's hand. In accordance with the invention, the spindle 34 is provided with manually squeezeable means 40 for controlling rotation of the spindle 34 within an operator's hand.

The manually squeezeable means 40 includes a split cylindrical member 42 which is telescoped over the spindle 34 and serves as a journal for the spindle 34. The split cylindrical member 42 is preferably formed of a resilient readily deformable plastic material and may have a smooth, or preferably, a slightly textured internal surface for slideably frictionally engaging said spindle 34 for controlling rotation of the spindle.

Slightly texturing the external surface of the spindle 34 and the internal surface of the split cylindrical member 42 will facilitate the frictional engagement between the spindle 34 and the cylindrical member 42. Surface texture can be provided by knurling, ribbing, scoring or the like.

In order to facilitate gripping of the split cylindrical member 42 there is telescoped over the split cylindrical member 42 a resilient friction sleeve 44 formed of a rubber-like material having a foam appearing surface. The sleeve 44 is readily gripped in an operator's hand and at the same time provides for frictional gripping of the split cylindrical member 42.

It will be seen that the enlargement 38 serves to retain both the split cylindrical member 42 and the sleeve on the spindle 34 against axial removal.

Figure 4:
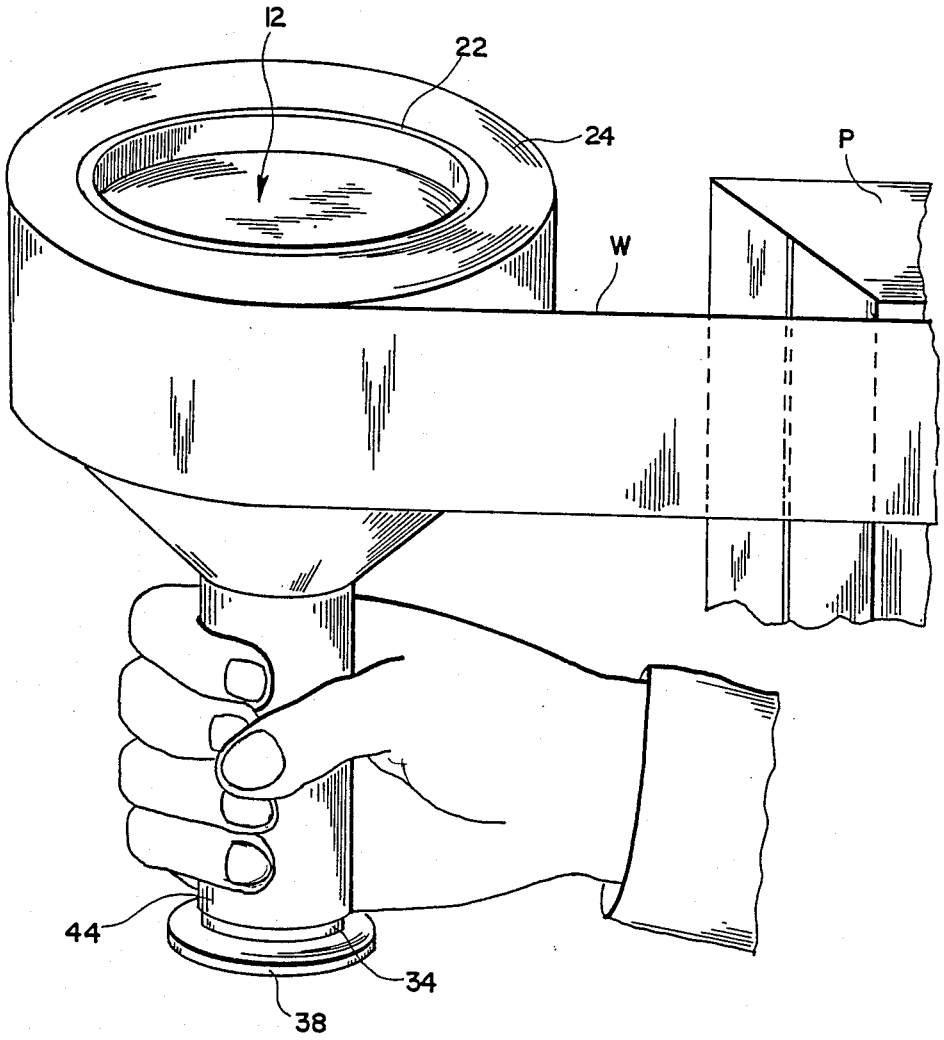
FIG. 4 is a diagrammatic perspective view showing the tool in use in dispensing and applying an elongated web of flexible plastic film.

A typical usage of the tool 20 is illustrated in FIG. 4 where a web W of stock material is being applied to a package P. The web W is tensioned as desired by gripping the sleeve 44 with the resulting closing of the split cylindrical member 42 about the spindle 34. It will be apparent that as the gripping pressure is increased, the resistance to rotation of the spindle 34 within the split cylindrical member 42 increases, and in a like manner the tension of the web W increases.

Although only a preferred embodiment of the dispensing tool has been described and illustrated, it is to be understood that minor changes in the dispensing tool may be made without departing from the spirit and scope of the appended claims.

What is claimed as new is:

1. A tool for manually dispensing and applying a web of elongated flexible stock material from a roll of the stock material carried by an open core, said tool comprising a head of a configuration and size for forced frictional engagement in such a core, said head having an axis, a plastic spindle having a textured cylindrical external surface carried by said head in projecting relation along said axis and forming a handle for said head, a split cylindrical member having a textured internal surface rotatably journaled on said spindle for selective clamping engagement with said spindle, said split cylindrical member forming manually squeezable means for controlling rotation of said spindle and said head, and a sleeve surrounding said split cylindrical member and forming grip means for deforming said split cylindrical member.

2. A tool according to claim 1 wherein said sleeve is formed of a rubber-like material having a friction surface.

3. A tool according to claim 1 wherein said sleeve is formed of a rubber-like material having a foam appearing friction surface.

4. A tool according to claim 1 wherein said spindle has a free end remote from said head, and said spindle free end includes an enlargement retaining said split cylindrical member and said sleeve on said spindle against axial removal.

5. A tool for manually dispensing and applying a web of elongated flexible stock material from a roll of the stock material carried by an open core, said tool comprising a head of a configuration and size for forced frictional engagement in such a core, said head having an axis, a spindle fixedly carried by said head in projecting relation along said axis and forming a handle for said head, a split cylindrical member rotatably journaled on said spindle for selective clamping engagement with said spindle, said split cylindrical member forming manually squeezable means for controlling rotation of said spindle and said head and a sleeve surrounding said split cylindrical member and forming grip means for deforming said split cylindrical member.

6. A tool according to claim 5 wherein said sleeve is formed of a rubber-like material having a friction surface.

7. A tool according to claim 5 wherein said sleeve is formed of a rubber-like material having a friction surface.

8. A tool for manually dispensing and applying a web of elongated flexible stock material from a roll of the stock material carried on an open core, said tool comprising:

a head of a configuration and size for forced frictional engagement in such a core, said head having an axis;

a spindle fixedly carried by said head in projecting relation along said axis and forming a handle for said head;

a manually squeezable means surrounding said spindle in frictional relation therewith for controlling rotation of said spindle and said head; and a sleeve surrounding said manually squeezable means in frictional relation therewith to form means for gripping said manually squeezable means, said manually squeezable means and said spindle having a first coefficient of friction therebetwen less than a second coefficient of friction between said sleeve and said manually squeezable means, thereby accommodating comfortable gripping of said sleeve to effect manual control of the rotation of said spindle and said head.

* * * * *